US010365052B2

(12) United States Patent
Anderson

(10) Patent No.: US 10,365,052 B2
(45) Date of Patent: Jul. 30, 2019

(54) SELF-CLEANING HEAT EXCHANGE ASSEMBLY

(71) Applicant: General Electric Company, Schenectady, NY (US)

(72) Inventor: Henrik Tobias Anderson, Vaxjo (SE)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 320 days.

(21) Appl. No.: 15/155,155

(22) Filed: May 16, 2016

(65) Prior Publication Data

US 2017/0328655 A1 Nov. 16, 2017

(51) Int. Cl.

| | |
|---|---|
| ***F28G 1/04*** | (2006.01) |
| ***F28D 7/16*** | (2006.01) |
| ***F28G 15/04*** | (2006.01) |
| ***F27B 3/08*** | (2006.01) |
| ***F27B 3/26*** | (2006.01) |
| ***F27D 17/00*** | (2006.01) |

(52) U.S. Cl.

CPC ..... *F28G 1/04* (2013.01); *F27B 3/085* (2013.01); *F27B 3/26* (2013.01); *F27D 17/003* (2013.01); *F28D 7/16* (2013.01); *F28G 15/04* (2013.01)

(58) Field of Classification Search

CPC ..... F28G 1/04; F28G 15/003; F28G 15/02; F28G 15/04; F28G 3/085; F27B 3/085; F27B 3/26; F27D 17/003; F28D 7/16

See application file for complete search history.

(56) References Cited

U.S. PATENT DOCUMENTS 953,958 A * 4/1910 Kelly ..... F24H 1/205 110/322
1,621,417 A * 3/1927 Knapp ..... F28G 1/04 122/379
1,898,596 A * 2/1933 Piatt ..... F23J 3/02 122/379
2,233,066 A * 2/1941 Watson ..... F23J 3/02 134/57 R
2,914,039 A * 11/1959 Smith ..... F22B 9/00 122/379
3,762,464 A * 10/1973 Takahashi ..... B08B 9/045 165/95

(Continued)

FOREIGN PATENT DOCUMENTS

CN 201589575 U 9/2010
CN 103575160 A 2/2014

(Continued)

OTHER PUBLICATIONS

Invitation to Pay Additional Fees issued in connection with corresponding PCT Application No. PCT/US2017/028048 dated Sep. 28, 2017.

*Primary Examiner* — Devon Russell

(74) *Attorney, Agent, or Firm* — Eversheds Sutherland (US) LLP

(57) ABSTRACT

The present application provides a heat exchange assembly for exchanging heat between a coolant and a gaseous medium. The heat exchange assembly may include an outer jacket, a number of gas tubes positioned within the outer jacket, and a self-cleaning system positioned about the gas tubes. The self-cleaning system may include a number of chains extending through the gas tubes.

17 Claims, 2 Drawing Sheets

(56) References Cited

U.S. PATENT DOCUMENTS

| | | | | | |
|---|---|---|---|---|---|
| 4,319,631 | A * | 3/1982 | Margraf | F28F 1/02 | 165/175 |
| 4,412,583 | A * | 11/1983 | Megerle | F28G 3/06 | 165/95 |
| 4,471,725 | A * | 9/1984 | Holden | F28G 1/04 | 122/379 |
| 4,562,886 | A * | 1/1986 | Holm | F28G 1/08 | 122/379 |
| 4,664,180 | A * | 5/1987 | Stevenson | F28D 21/0008 | 165/901 |
| 5,127,547 | A * | 7/1992 | Gerich | B01F 15/0454 | 222/137 |
| 5,437,264 | A * | 8/1995 | McCormick | F24H 1/205 | 122/18.2 |
| 8,945,386 | B2 * | 2/2015 | Lee Wang | B01D 65/02 | 210/321.7 |
| 2009/0266234 | A1 | 10/2009 | Ahman et al. | | |
| 2010/0101760 | A1 | 4/2010 | Wedde et al. | | |
| 2013/0195138 | A1 * | 8/2013 | Monti | C21C 5/40 | 373/80 |
| 2013/0300038 | A1 | 11/2013 | Ose et al. | | |
| 2014/0060055 | A1 | 3/2014 | Sorhuus et al. | | |
| 2014/0245883 | A1 | 9/2014 | Wieslander et al. | | |

FOREIGN PATENT DOCUMENTS

| | | | | |
|---|---|---|---|---|
| DE | 30 32 944 | A1 | | 5/1982 |
| EP | 0 242 097 | A1 | | 10/1987 |
| FR | 1 027 888 | A | | 5/1953 |
| GB | 2 124 322 | A | | 2/1984 |
| JP | 2004169973 | A | * | 6/2004 |
| WO | 2012/038906 | A2 | | 3/2012 |

* cited by examiner

SELF-CLEANING HEAT EXCHANGE ASSEMBLY

TECHNICAL FIELD

The present application and the resultant patent relate generally to metallurgical processing equipment and more particularly relate to a self-cleaning heat exchange assembly for use with cooling flue gases produced by an electric arc furnace and the like.

BACKGROUND OF THE INVENTION

Steel, aluminum, and other types of metals may be produced and/or refined in a metallurgical furnace such as an electric arc furnace and the like. Such a furnace may generate large volumes of hot flue gases. Such hot flue gases may contain particulates, sublimates, and other types of pollutants. The hot flue gases thus must be cleaned to remove such pollutants before the gases are released to the environment or otherwise used or processed. Before cleaning, the hot flue gases may be cooled in a heat exchange assembly. The heat exchange assembly may include a number of gas tubes contained within an outer jacket. The flue gases may flow through the gas tubes with a coolant flowing within the outer jacket for heat exchange therewith. Once cooled, the flue gases may pass through a fabric filter and the like so as to trap and separate the particulate matter from the flue gases.

The particulate matter, however, may tend to build up over time on the walls of the gas tubes. Such a buildup may impact on the overall efficiency of the heat exchange assembly. The heat exchange assembly thus requires regular maintenance. Specifically, the gas tubes may be manually cleaned with rotating brushes, water jets, and/or other types of cleaning devices. As a result, the electric arc furnace and the heat exchange assembly may be offline for an extended period of time for cleaning and maintenance.

SUMMARY OF THE INVENTION

The present application and the resultant patent thus provide a heat exchange assembly for exchanging heat between a coolant and a gaseous medium. The heat exchange assembly may include an outer jacket, a number of gas tubes positioned within the outer jacket, and a self-cleaning system positioned about the gas tubes. The self-cleaning system may include a number of chains extending through the gas tubes for contact therewith.

The present application and the resultant patent further provide a method of cleaning a heat exchange assembly used to cool particulate laden flue gases. The method may include the steps of flowing the flue gases through a number of gas tubes in the heat exchange assembly, positioning a chain in each of the gas tubes, and agitating the chain in each of the gas tubes to dislodge the particulates therein.

The present application and the resultant patent further provide an electric arc furnace production plant. The electric arc furnace production plant may include an electric arc furnace, a heat exchange assembly positioned downstream of the electric arc furnace, and a filter positioned downstream of the heat exchange assembly. The heat exchange assembly may include a self-cleaning system.

These and other features and improvements of the present application in the resultant patent will become apparent to one of ordinary skill in the art upon review of the following detailed description when taken in conjunction with the several drawings and the appended claims.

DETAILED DESCRIPTION

Figure 1:
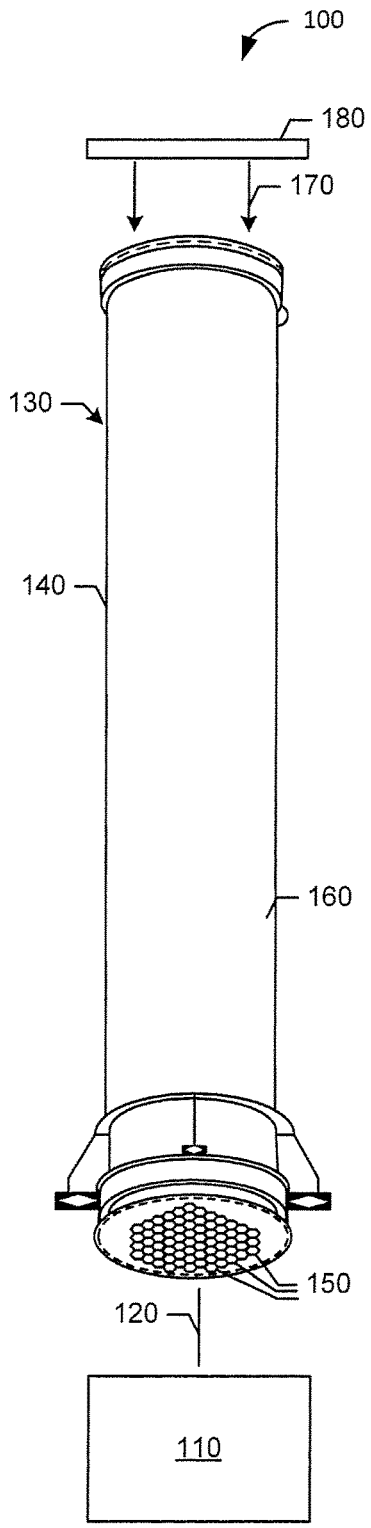
FIG. 1 is a schematic diagram of a portion of an electric arc furnace production plant with an electric arc furnace, a heat exchange assembly, and a fabric filter.

Referring now to the drawings, in which like numerals refer to like elements throughout several views, FIG. 1 shows an example of an electric arc furnace production plant 100. The electric arc furnace production plant 100 may include an electric arc furnace 110. The electric arc furnace 110 may be used to produce and/or refine different types of metals and the like. The electric arc furnace 110 may produce a large volume of a gaseous medium such as flue gases 120 and the like. As described above, the flue gases 120 may contain particulates, sublimates, and other types of pollutants. The electric arc furnace 110 may be of conventional design.

The electric arc furnace production plant 100 may include a heat exchange assembly 130. The heat exchange assembly 130 may be used to cool the flue gases 120 as the flue gases 120 exit the electric arc furnace 110. The heat exchange assembly 130 may include a number of tube heat exchangers 140. The tube heat exchangers 140 may be arranged in a parallel configuration or otherwise. Generally described, each tube heat exchanger 140 may include a number of gas tubes 150 positioned within an outer jacket 160. The flue gases 120 may flow through the gas tubes 150 while a coolant 170, such as water and the like, may flow through the outer jacket 160 for heat exchange therewith. Other types of coolants may be used herein. The flue gases 120 and the coolant 170 may be arranged in a counter-flow configuration, a cross-flow configuration, or in any suitable configuration. The gas tubes 150 and the outer jacket 160 may have any suitable size, shape, or configuration. Many different types of tube heat exchangers 140, gas tubes 150, and other types of heat exchange components also may be used therein.

The electric arc furnace production plant 100 also may include one or more fabric filters 180. The fabric filters 180 may be positioned downstream of the heat exchange assembly 130 so as to remove particulate matter and the like from the flue gases 120. The fabric filters 180 may have any suitable size, shape, or configuration. Because the fabric filters 180 are positioned downstream of the heat exchange assembly 130, however, the particulate matter in the flue gases 120 may tend to build up within the gas tubes 150.

Figure 2:
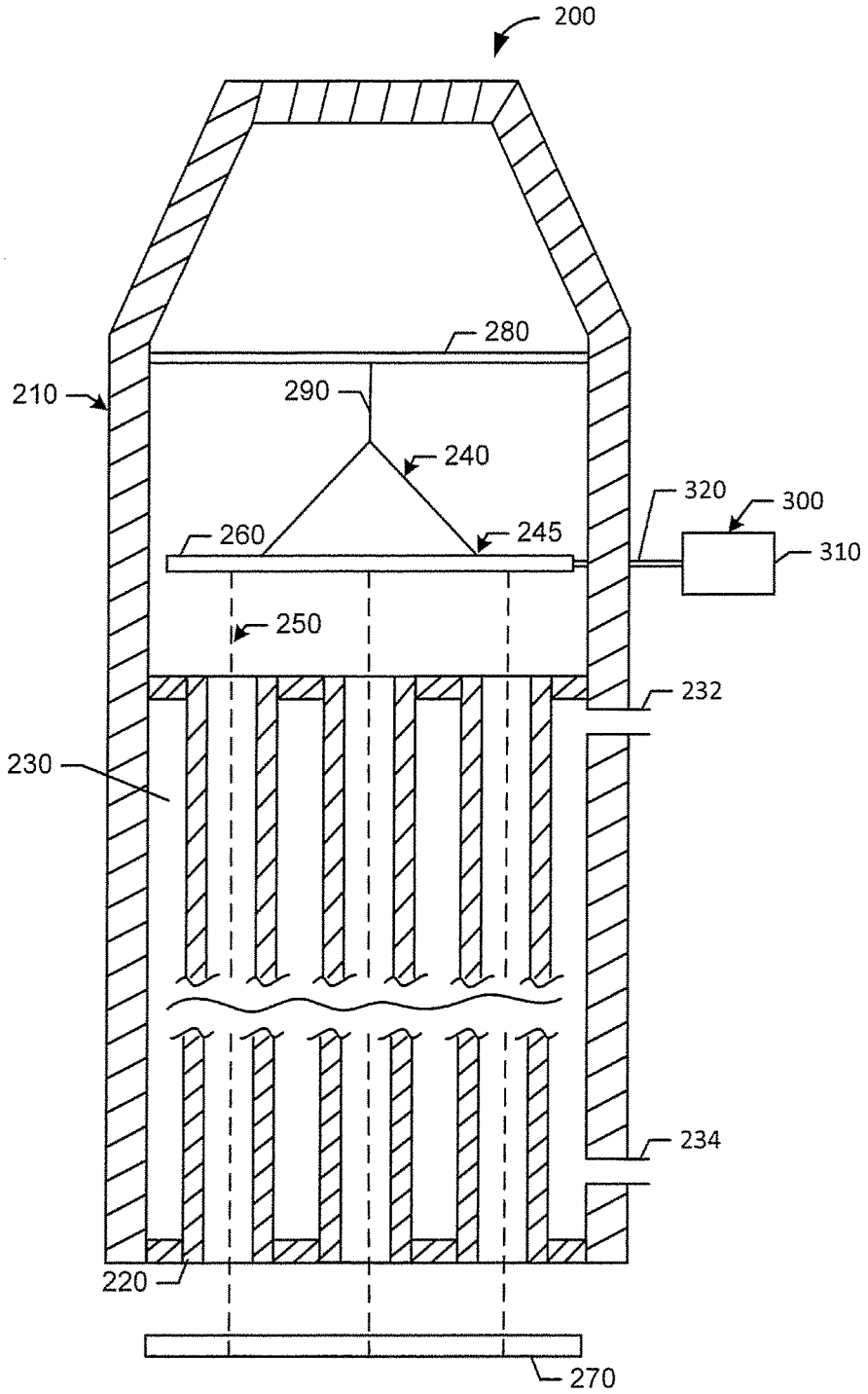
FIG. 2 is a schematic diagram of a heat exchange assembly as may be described herein.

FIG. 2 shows a portion of a heat exchange assembly 200 as may be described herein. The heat exchange assembly 200 may include any number of tube heat exchangers 210. The tube heat exchangers 210 may include a number of gas tubes 220 positioned within an outer jacket 230. Although only three (3) gas tubes 220 are shown for the purposes of clarity, it is understood that the tube heat exchanger 210 may include any number of gas tubes 220. Specifically, hundreds of gas tubes 220 may be used herein depending upon the diameter of the outer jacket 230. The gas tubes 220 and the outer jacket 230 may have any suitable size, shape, or configuration. The flue gases 120 may pass through the gas tubes 220 while the coolant 170 may flow through the outer jacket 230 for heat exchange therewith. The coolant 170 may enter through an inlet 232 and leave via an exit 234.

The tube heat exchanger 210 also may include a self-cleaning system 240. The self-cleaning system 240 may include a chain assembly 245 with a number of chains 250. Specifically, one or more of the chains 250 may extend through each or some of the gas tubes 220. The chains 250 may include conventional link chains, wires, or any type of somewhat flexible extensions that are capable of striking the walls of the gas tubes 220 with sufficient force so as to dislodge any particulate matter therein. The chains 250 may have any suitable size, shape, or configuration. The chains 250 may extend from an upper bar 260 positioned above the gas tubes 220 at a first end to a lower bar 270 positioned beneath the gas tubes 220 at a second end. The bars 260, 270 may have any suitable size, shape, or configuration. The chain assembly 245 may be supported from a channel bar 280 and the like above the gas tubes 220. The chain assembly 245 may be supported by a support wire 290 and the like extending from the channel bar 280 or elsewhere. The support wire 290 may have any suitable size, shape, or configuration. Other types of support devices may be used herein. Other components and other configuration may be used herein.

The self-cleaning system 240 also may include an agitation device 300. In this example, the agitation device 300 may include an air cylinder 310 and the like. The agitation device 300 may include a piston 320 extending from the air cylinder 310. The air cylinder 310 and the piston 320 may be of conventional design and may have any suitable size, shape, or configuration. The piston 320 may be in communication with the upper bar 260 of the chain assembly 245 for movement therewith. Other types of connections may be used herein. The agitation device 300 may include any type of device for providing reciprocal movement. Other examples include a solenoid and the like. Other types of movement also may be used herein. A number of agitation devices 300 may be used herein. For example, two air cylinders 310 may be positioned in a perpendicular arrangement. The agitation devices 300 may be mounted outside of the outer jacket 230 or elsewhere. Although the flue gases 120 alone may promote movement of the chains 250, the agitation devices 300 provide the chains 250 with sufficient force to remove the particulate matter.

In use, the agitation device 300 of the self-cleaning system 240 may maneuver the upper bar 260 of the chain assembly 245 in back and forth reciprocal motion and the like. This motion causes the chains 250 to strike the inner walls of the gas tubes 220. This striking motion breaks the forces holding any adhered particulate matter. The released particulate matter thus may pass through the gas tubes 220 so as to be captured downstream. The agitation device 300 of the self-cleaning system 240 may operate continuously or periodically as needed.

The self-cleaning system 240 thus cleans the gas tubes 220 during operation. As a result, the self-cleaning system 240 avoids or at least reduces the need to take the heat exchange assembly 200 and/or the electric arc furnace production plant 100 offline for periodic cleaning. Overall downtime thus may be reduced as well as the associated time and expense required for manual cleaning. Overall production plant efficiency thus may be increased.

Although the heat exchange assembly 200 and the self-cleaning system 240 have been discussed herein in the context of the electric arc furnace production plant 100, it will be understood that that the heat exchange assembly 200 and the self-cleaning system 240 may be used to cool flue gases 120 or any type of gaseous medium with particulate matter from any source.

It should be apparent that the foregoing relates only to certain embodiments of the present application and the resultant patent. Numerous changes and modifications may be made herein by one skilled in the art without departing from the general spirit and scope of the invention as defined by the following claims and the equivalents thereof.

I claim:

1. A heat exchange assembly for exchanging heat between a coolant and a gaseous medium, comprising:
- an outer jacket;
- a plurality of gas tubes positioned within the outer jacket; and
- a self-cleaning system positioned about the plurality of gas tubes,
- the self-cleaning system comprising:
  - a plurality of chains attached to an upper bar to extend from the upper bar through the plurality of gas tubes,
  - an agitation device comprising an air cylinder and a piston, the piston extending from the air cylinder to contact the upper bar for reciprocal movement of the upper bar and attached plurality of chains, and
  - the upper bar connected to a channel bar by a support wire.

2. The heat exchange assembly of claim 1, wherein the gaseous medium comprises flue gases.

3. The heat exchange assembly of claim 1, wherein the gaseous medium flows through the plurality of gas tubes.

4. The heat exchange assembly of claim 3, wherein the coolant flows through the outer jacket for heat exchange with the gaseous medium.

5. The heat exchange assembly of claim 1, wherein the upper bar is attached to a first end of the plurality of chains.

6. The heat exchange assembly of claim 5, wherein the self-cleaning system further comprises a lower bar attached to a second end of the plurality of chains.

7. The heat exchange assembly of claim 1, wherein the agitation device in communication with the plurality of chains is mounted outside the outer jacket.

8. The heat exchange assembly of claim 7, wherein the reciprocal motion of the upper bar of the self-cleaning system provides the plurality of chains with sufficient force to remove particulate matter from the plurality of gas tubes.

9. The heat exchange assembly of claim 7, wherein the self-cleaning system comprises a plurality of agitation devices.

10. The heat exchange assembly of claim 7, further comprising a filter downstream of the outer jacket.

11. The heat exchange assembly of claim 1, wherein the plurality of chains comprises a plurality of link chains.

12. The heat exchange assembly of claim 1, further comprising an electric arc furnace upstream of the outer jacket.

13. A method of cleaning a heat exchange assembly used to cool particulate laden flue gases, comprising:
- arranging a plurality of gas tubes within an outer jacket of the heat exchange assembly;
- arranging a self-cleaning system about the plurality of gas tubes, the self-cleaning system comprising:
  - a plurality of chains attached to an upper bar to extend from the upper bar for a chain of the plurality of chains to extend through each of the plurality of gas tubes,
  - an agitation device comprising an air cylinder and a piston, the piston extending from the air cylinder to contact the upper bar for reciprocal movement of the upper bar and attached plurality of chains, and the upper bar connected to a channel bar by a support wire;

flowing the flue gases through the plurality of gas tubes; and agitating the chain in each of the plurality of gas tubes to dislodge the particulates therein.

14. An electric arc furnace production plant, comprising:

an electric arc furnace;

a heat exchange assembly positioned downstream of the electric arc furnace;

a plurality of gas tubes arranged within an outer jacket of the heat exchange assembly;

a self-cleaning system arranged about the plurality of gas tubes, the self-cleaning system comprising:

a plurality of chains attached to an upper bar to extend from the upper bar for a chain of the plurality of chains to extend through each of the plurality of gas tubes, an agitation device comprising an air cylinder and a piston, the piston extending from the air cylinder to contact the upper bar for reciprocal movement of the upper bar and attached plurality of chains to dislodge particulate matter within the plurality of gas tubes, and the upper bar connected to a channel bar by a support wire;

a filter positioned downstream of the heat exchange assembly operable to capture dislodged particulate matter.

15. The electric arc furnace production plant of claim 14, wherein the self-cleaning system comprises a plurality of agitation devices.

16. The electric arc furnace production plant of claim 14, wherein the plurality of chains comprises a plurality of link chains.

17. The electric arc furnace production plant of claim 14, wherein the agitation device in communication with the plurality of chains is mounted outside the outer jacket.

* * * * *